United States Patent [19]

Glover

[11] 3,949,574

[45] Apr. 13, 1976

[54] SUBLIMATIC PRINTING MACHINE

[76] Inventor: Richard Donovan Glover, Ings Mills, Dale St., Ossett, Yorkshire, England

[22] Filed: May 29, 1974

[21] Appl. No.: 474,460

Related U.S. Application Data

[63] Continuation-in-part of Ser. No. 381,202, July 20, 1973, abandoned.

[52] U.S. Cl. ..... 68/5 C; 8/2.5 R; 38/15; 68/13 R; 101/470

[51] Int. Cl.[2].. D06B 1/10; B41M 5/02; D06F 71/34

[58] Field of Search ..... 38/15, 14, 16, 17; 8/2.5, 8/149.3; 101/470; 68/5 C

[56] References Cited

UNITED STATES PATENTS

| | | | |
|---|---|---|---|
| 1,895,243 | 1/1933 | Dort | 8/2.5 |
| 2,007,321 | 7/1935 | Yosyk | 38/16 |
| 2,663,251 | 12/1953 | Baumrucker | 101/27 X |
| 3,138,458 | 6/1964 | Kimble et al. | 101/470 |
| 3,486,255 | 12/1969 | Schlemon | 38/16 |
| 3,490,371 | 1/1970 | Games | 101/426 |
| 3,567,356 | 3/1971 | Eltz et al. | 8/149.3 |
| 3,632,291 | 1/1972 | Defago et al. | 101/470 |
| 3,768,280 | 10/1973 | Kannegiesser et al. | 101/470 |

FOREIGN PATENTS OR APPLICATIONS

| | | | |
|---|---|---|---|
| 548,692 | 10/1942 | United Kingdom | 38/15 |

*Primary Examiner*—Clyde I. Coughenour
*Attorney, Agent, or Firm*—Fred Philpitt

[57] ABSTRACT

A machine for the colour printing of textile webs or structures such as carpets and tiles which are tufted or non-woven wherein the colour is sublimatic dyestuff carried by a printing foil and this is placed over the textile structure with the dyestuff facing the textile structure to form a sandwich. Heat is applied by a heating plate to vaporize the dyestuff, and an air flow through the sandwich is created by making the heating plate of sintered, air permeable metal, supporting the sandwich on an air permeable support, and by creating an air pressure differential across the sandwich. The support includes a grid plate on which the textile web is supported and there is an evacuation chamber under the grid plate to assist in producing or for producing the air flow. The chamber and heating plate are movable apart for loading and unloading of the machine.

1 Claim, 10 Drawing Figures

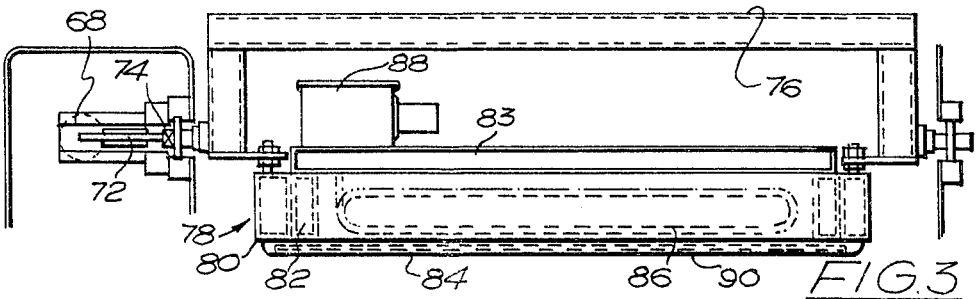
FIG. 3
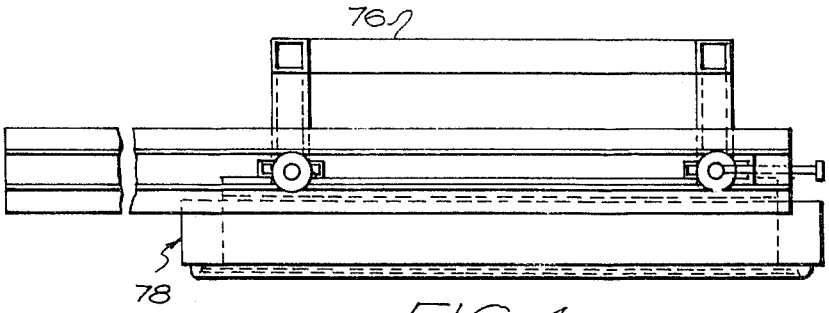
FIG. 4
FIG. 5
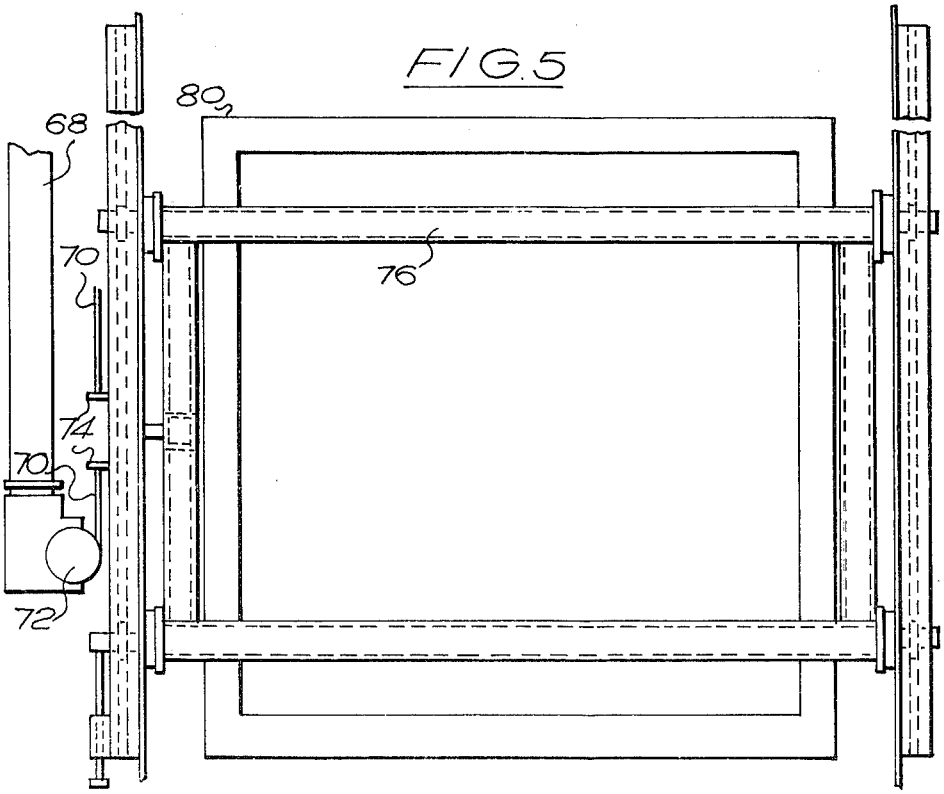

SUBLIMATIC PRINTING MACHINE

BACKGROUND OF THE INVENTION

This application is a continuation-in-part application on U.S. application Ser. No. 381,202, filed July 20, 1973; now abandoned.

The invention contained herein relates to an apparatus for the colour printing, using sublimatic dyes, of air permeable sheet structures composed of or including material on and to which the sublimatic dye in the vapour phase will precipitate and adhere. Such sheet structures may include air permeable sheets composed of or including thermoplastic material such as plastics or resins not of a non-fibrous or filamentary nature, but more commonly will be of or include fibres or filaments which are of a thermoplastic material such as plastics or resin, or which are coated with such thermoplastic material. Sheet structures of the latter category include knitted webs or sheets, woven and non-woven webs or sheets and tufted webs or sheets i.e. carpets, floor coverings, rugs and carpet tiles. The actual material of or coating on, the fibres and filaments will depend upon the sublimatic dyestuff which is used, but for commonly known dyestuffs, synthetic fibres and filaments of DICEL, TRICEL and NYLON (Registered Trade Marks) may be used and in general the fibres and filaments or coatings may be selected from the range polyamides, polyesters and acrylics.

It will be appreciated however as the explanation of the invention proceeds that the actual dyestuff and sheet structure which are used are not of the essence of the principle of the invention, provided that the dyestuff is of the sublimatic type, i.e. it vaporizes upon the application of heat, the sheet structure is air permeable, and comprises or includes a material upon and to which the dyestuff in vapour state precipitates and adheres.

At present, there does not appear to be a disperse sublimatic dye which has an affinity with natural fibres such as wool, cotton etc., but it is believed that present development will result in one or more disperse sublimatic dyes being produced which will be capable of being used for dyeing natural fibres. The present invention may be adapted readily for use with textile sheet structures largely of natural fibres upon the advent of suitable sublimatic dyestuff.

In printing using a sublimatic dye, the dye is printed on a carrier sheet, usually of paper, to produce what has become known as a printing foil and the paper is heated causing the dye to "sublime" in that the dyestuff in the dye vaporizes, and if the sheet structure of the nature set forth above is located adjacent the carrier sheet side carrying the dye, the colour precipitates on the sheet structure in the same pattern as the dye appears on the carrier sheet. Several colours can therefore be printed simultaneously although the process has been used for blanket colouring of a sheet structure.

One advantage of the sublimatic process is that only the dyestuff is vaporized and the other constituents of the dye are left on the carrier sheet; consequently the sheet structure may not require any further processing, such as steam cleaning, to remove undesired residue after the printing process.

One disadvantage of sublimatic printing is that penetration of the dye vapour into the thickness of the sheet structure is poor, particularly with relatively thick sheet structures such as carpets or densely compacted sheet structures such as needled felts, and indeed in tests on needled felts, whilst the definition of the printed pattern has been extremely good, the dye penetration has not been sufficient to make for a commercially acceptable article because with wear, the printing is quickly removed. Because of this disadvantage sublimatic colour printing has not found commercial application beyond the printing on thin woven or knitted sheets such as are used for manufacturing garments of outer wear such as skirts, ties, dresses and the like.

DISCUSSION OF PRIOR ART

A number of machines for the sublimatic printing processes are now available. Basically, these machines operate either on a press principle or on a roll and calender principle. This invention is not concerned with roll and calender machinery and therefore no further discussion of same is given. Press type machinery for sublimatic printing, apart from a number of differences between types of machines, operate basically upon the principle of a pair of platens which trap the sandwich of sheet structure and printing foil and apply heat to produce the print. Several forms of printing presses are set forth in "International Dyer of Textile Printer" of Mar. 19, 1971 in an article by D. Burtonshaw. In this article, Burtonshaw recognises the difficulty of obtaining depth of dyeing when discussing the particular dyestuffs (disperses dyestuffs) which are suitable for the transfer printing process. Furthermore, Burtonshaw confirms the requirement for the application of pressure to the sandwich when performing the printing operation. He states that "the depth of shade produced rises rapidly with increasing pressure to a maximum at about 1.5 lb. per square inch." In this article, the transfer printing of light, thin fabrics, knitwear, cut and sew panels, dress lengths for the fashion trade; placement or motif printing; and sundry small items, and the machinery set forth is not really suitable for printing relatively thick fabrics such as carpets, the printing of which brings its own problems.

The major problem, as far as I am aware, in the adoption of transfer printing for pile fabrics such as tufted or other carpets, is one of penetration of dyestuff down into the pile. More colouration of the tips of the tufts or top of the pile is not acceptable, as the pattern or colour will quickly be lost as a result of wear of the pile in use. The CIBA review of January 1967 recognises this problem because it is stated at page 48 of this review paragraph 2, sub paragraph (*a*) that dyestuff *penetration* is a major problem. However, it has not been shown that there exists any effective press for transfer printing carpeting which will give effective penetration of the dyestuff into the carpet pile. There has been a proposal to transfer print fabrics on a rotatable drum around which the fabric is wound and is covered with the transfer printing foil. The interior of the drum is vacated in order to draw the printing foil to the fabric. Apart from the fact that this machine is in no way a press, it requires the pressure at the printing foil to be at atmospheric, and as mentioned in the International Dyer of Textile Printer of Mar. 19, 1971, this is not the best condition for transfer printing. Desirably, the transfer printing foil should be under a positive pressure. It is against this background that the present invention was made.

OBJECTS OF THE INVENTION

It is an object of the present invention to provide a press which is capable of sublimatic printing, with deep dyestuff penetration, a thick pile, air permeable fibrous sheet structure.

It is a further object of the present invention to provide a press which is capable of printing a carpet tile which is air permeable.

A still further object is to provide a press in which the application of pressure to the material being printed does not affect the efficiency of printing.

BRIEF DESCRIPTION OF THE INVENTION

The invention provides in a press for the colour printing, using sublimatic dyes, of an air permeable sheet structure, comprising press platen means, and support platen means located face to face, pressure means adapted to press a sandwich comprising the pile fabric and a sublimatic printing foil between the platen means so that the foil lies with its printed face in contact with the fabric pile and is pressed by the press platen means, and heating means for heating the sublimatic printing foil through the press platen means to release the dyestuff; the improvement residing in that the press platen means is defined by an air permeable, sintered metal plate and the support platen means is air permeable, and there is means for creating a flow of air through the sintered plate, the sandwich of foil and fabric, and the support platen means when the dyestuff is in the vapour phase.

The support means preferably includes a flat grid structure forming the top of a chamber which is connected to a source of vacuum, to create said flow of air.

The heating means may be a plurality of heating elements created adjacent press platen means. The press platen means is preferably located above the grid structure and said grid structure and press platen means are movable together into air sealing engagement with a fabric sheet structure and superimposed printing foil supported on said grid structure.

The press platen means is preferably mounted for horizontal movement relative to the grid structure to expose same and permit the location on and removal from the grid structure, of sheet structures to be printed, and printed, and their associated printing foils.

BRIEF DESCRIPTION OF THE DRAWINGS

FIGS. 3, 4 and 5 are respectively a front elevation, a side elevation and a plan of one of the hood frames and its press platen means shown in FIGS. 1 and 2;

Figure 1:
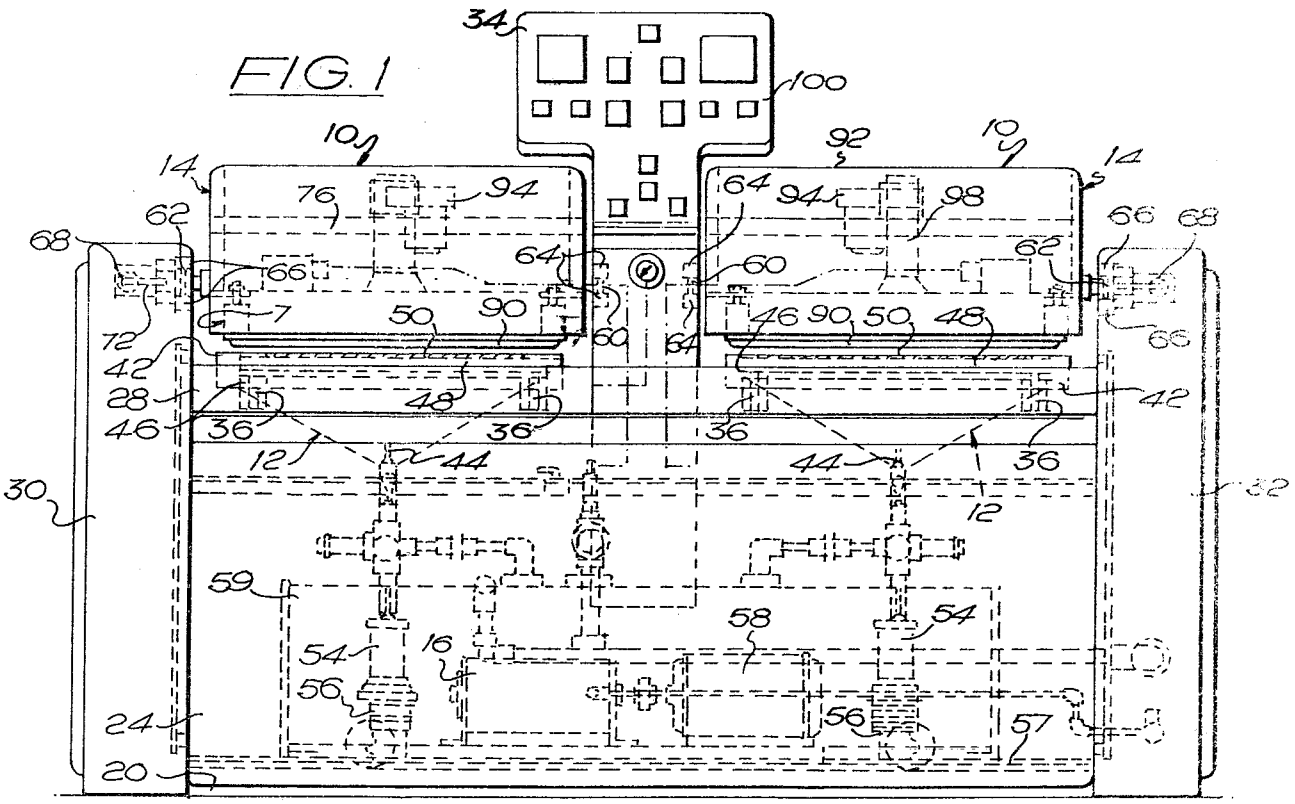
FIG. 1 is a front elevation of a machine according to the invention.

The machine shown in the drawings is for the printing of square, air permeable, carpet tiles and is a "twin" machine in that it has two identical printing heads so that two tiles can be printed simultaneously. The machine can be operated however for the operation of the two printing heads alternately or the operation of one only of the printing heads whilst the other is being cleaned, serviced or repaired.

Figure 6:
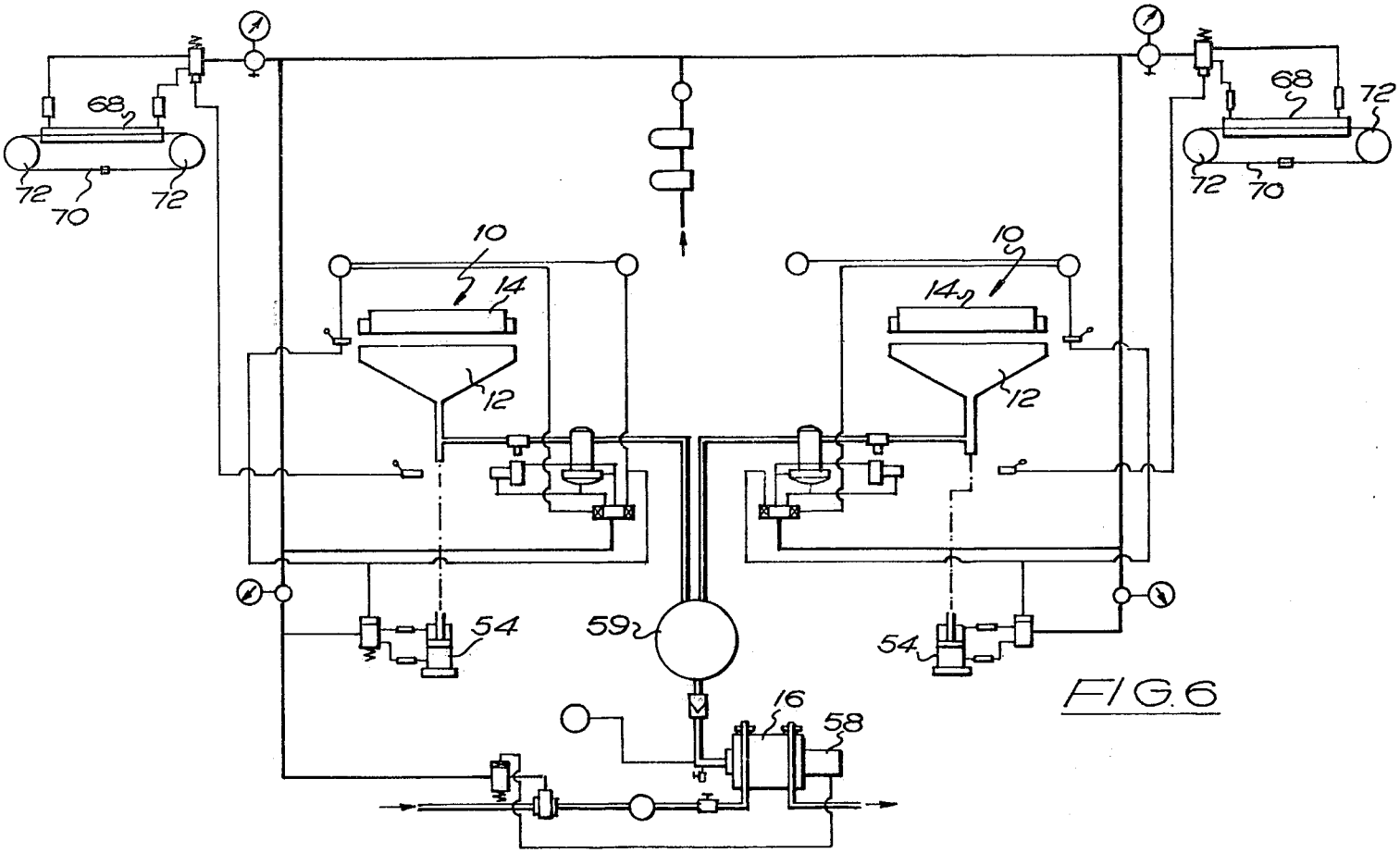
FIG. 6 is a circuit diagram of part of the pneumatic, vacuum and electrical systems of the machine shown in FIGS. 1 and 2.

For the basic principle of operation of each printing head, reference is best made in the first place, to FIG. 6. Each of the two heads is represented by numeral 10 and each is seen to comprise a vacuum chamber or tank 12 the top of which is covered by a grid structure, and heating plate structure 14. In the Figure, the top of tank 12 and the bottom of plate structure 14 are shown spaced slightly apart, but they can be moved into air sealing contact and are so moved together for the printing operation.

For the printing process, the tile to be printed is placed in register with the grid structure with the side to be printed facing upwards, the heating plate structure 14 having been moved horizontally, as it is able to do, relative to the tank 12 to permit the tile registration to be done easily. The sublimatic printing foil is placed in superposed relation to the tile with the dyestuff printing facing the tile and then the heating plate structure is moved back to the shown position.

Next, the heating plate structure 14 and tank 12 are moved together into air sealing contact, the heating plate structure operated to heat the printing foil and thereby release the dyestuff vapour and the tank 12 is vacated by a vacuum pump 16 to create a sub-atmospheric pressure in the tank thereby to set up a pressure differential between the sides of the tile. The heating plate structure has a heating plate which is of air permeated sintered metal, shown in section in FIG. 7, through which air is drawn during the printing operation. This air flow has the effect that airborne dyestuff vapour is drawn with the air down into the tile. The dyestuff vapour penetrates at least partially the thickness of the tile and certainly much better than it would if no air flow were created through the tile. Further particulars of the operation of the dyestuff penetration will be given when FIGS. 7 to 10 are explained in detail hereinafter. The vacuum, heating and air flow are applied for a pre-determined time depending upon the tile material and the dyestuff being used. At the end of this time, the heating plate structure 14 and tank 12 are moved apart, the heating plate structure moved horizontally clear of the tank, the printed tile and its printing foil removed and the printing head is ready for the next similar cycle of operations.

Figure 2:
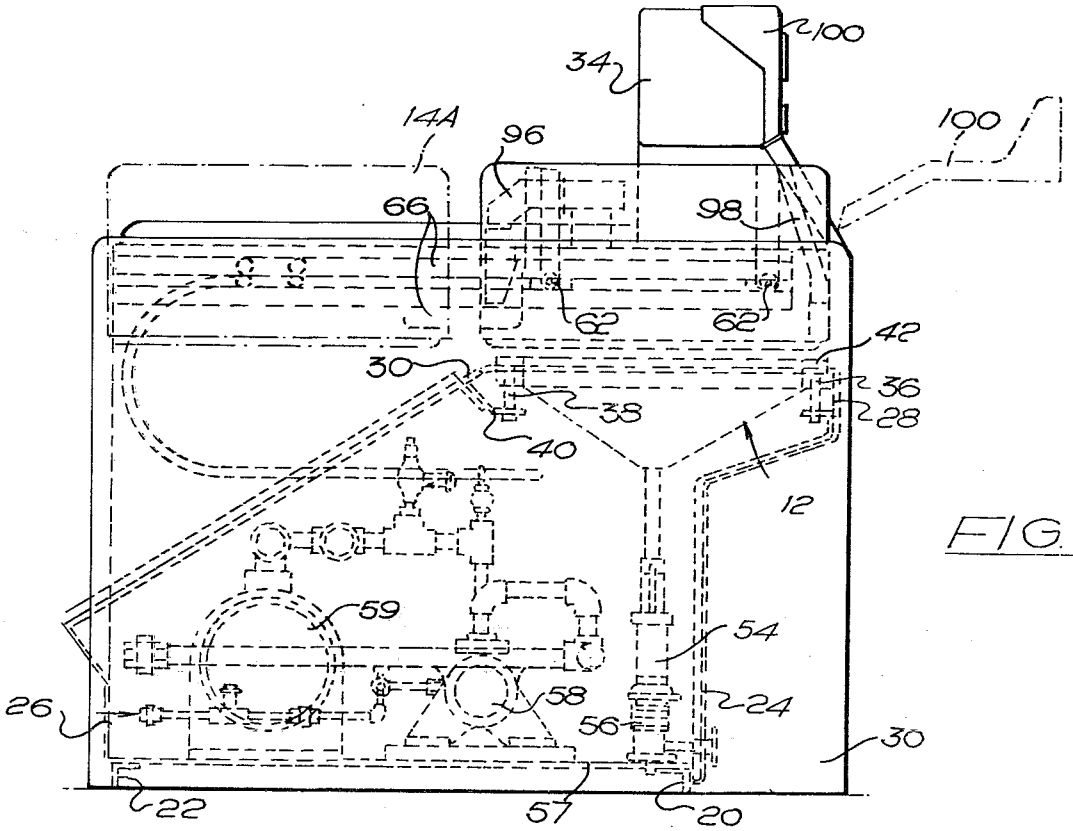
FIG. 2 is a side elevation of the machine shown in FIG. 1.

Structural details of the machine are now described with reference to FIGS. 1 to 5. Referring to FIGS. 1 and 2, the machine has a frame made up of spaced lower front and rear angle bars 20, 22, a front plate 24, a rear plate 26, and upper front and rear channel bars 28, 30. The sides of the frame are closed by side housings, 30, 32 and located centrally of the front of the machine is an instrument console 34.

The printing heads 10 are located to each side of console 34, and the vacuum tanks 12 are located between the front and rear channel bars 28, 30.

Each vacuum tank 12 is slidably mounted for up and down movement on four guide pins 36, 38 of which the pins 36 are secured to a lower flange of channel bar 28 whilst pins 38 are carried by brackets 40 secured to channel bar 30.

Each tank 12 comprises a square, hollow box section frame 42 having holes in which pins 36, 38 locate and downwardly depending sheet metal walls which define the tank body and lead to a lower outlett 44 through which the tank is vacated.

Figure 8:
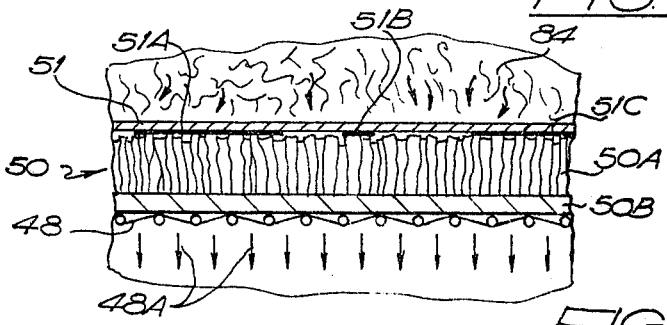
FIGS. 8, 9 and 10 are enlarged detailed views showing what takes place across the laminate as the printing proceeds.
Figure 9:
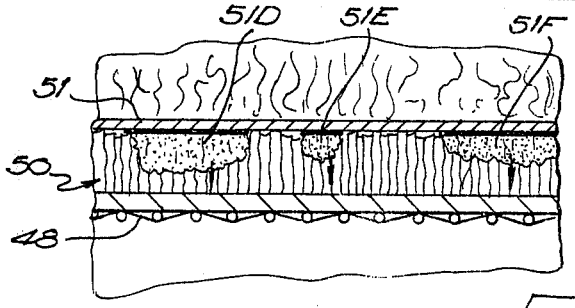
Figure 10:
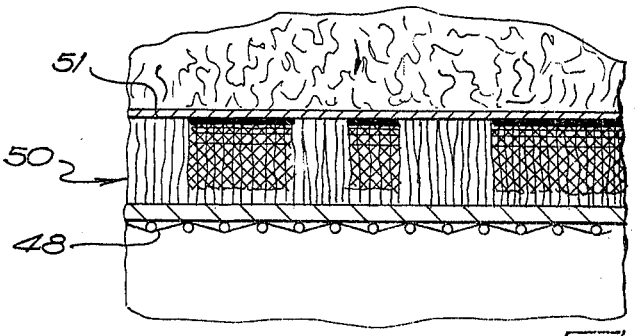

On the inner wall of frame 42 is a ledge 46 on which the grid structure 48 sits. This grid structure comprises a plurality of grid bars which are held one relative to the other in spaced parallel relationship and on expanded wire mesh screen which merely sits on top of the bars. The grid structure corresponds in dimension to the inner dimensions of frame 42 but is located under the top surface of the frame by an amount corresponding to the combined thickness of the sheet structure 50 (FIG. 1) to be printed, and its foil 51 (FIGS. 8 to 10). Thus, the sheet structure 50 and its foil 51 are located within frame 42 so that the foil lies flush with the top surface of the frame 42.

When it is desired to print sheet structures whose dimensions are smaller than the inner dimensions of the frame 42, a blanking plate having an aperture therein corresponding in size to the sheet structure is used, the sheet structure being located in the said aperture, and the blanking plate covering that area of the grid structure not covered by the sheet structure, to ensure the effective application of the vacuum and the creation of the air flow through the sheet structure.

The vacuum tanks 12 are adapted to be moved up and down individually in that each is connected to a short stroke pneumatic cylinder 54. The cylinders 54 are supported on screw jacks 56 and these in turn are carried by a base plate 57 extending between lower bars 20, 22. Adjustment of the screw jacks effects adjustment of the height of cylinders 54 and tanks 12, whereby the range over which the tanks 12 can be moved by cylinders 54 is adjusted.

The base plate also supports the vacuum pump 16 which is water cooled, an electric motor 58 connected to drive pump 16 and a vacuum reservoir 59 from which pump 16 exhausts air and which is in communication with outlets 44 of tanks 12.

Each of the heating plate structures 14 is mounted so as to be capable of being moved horizontally from front to rear of the machine between a forward position in which the heating plate structure is in superposed relationship with the associated vacuum tank 12 and a rearwards position, indicated in chain-dotted lines at 14A in FIG. 2, in which the heating plate structure is displaced horizontally of the associated tank 12.

To achieve this mobility of the heating plate structures, each structure has guide rollers 60, 62 on each side thereof and these rollers run respectively in guide rails 64, 66 which are located in the control console 34 and the associated end housing 32.

The means for moving each heating plate structure 14 comprises a double acting piston and cylinder device 68 contained in the associated end housing 32. The cylinder is stationary and the piston, which is movable in the cylinder, has its sides respectively connected to lengths of flexible member 70 (FIG. 5) which respectively are trained round pulleys 72 towards the front and rear of the end housing 32. The other ends of the members 70 are anchored to the heating plate structure as at 74 so that, in effect, the members 70 define an endless member trained between two pulleys 72 with the driving piston connected to one reach and the heating plate structure connected to the other reach. Movement of the piston therefore effects a similar, but opposite direction movement of the heating plate assembly.

Each heating plate assembly 14 (FIGS. 3, 4 and 5) is an inverted cradle frame 76 from which is hung a heating block 78. The heating block 78 is made up of a square hollow box section frame 80 on the inner wall and on the top of which are heat insulation layers 82, 83 and on the bottom of which is a metal heating plate 84, which is of special construction in that it is an air permeable sintered metal plate. Contained within the block 78 are electric heating elements 86 which receive power and are controlled from electrical control box 88.

On the underface of frame 80 there is a continuous sealing strip 90 of flexible material which is adapted to contact in an air sealing manner the top face of frame 42 of the associated vacuum tank when the heating plate structure is in the forward position and the tank 12 is moved upwards by cylinder 54. The sealing strip 90 is of such a thickness and compressibility in relation to the plate 84 that with the strip 90 sealing against the top surface of frame 42 of the associated vacuum tank, the plate 84 presses on the printing foil and the tile to be printed for the effective application of heat to the foil without completely deforming the pile of the tile.

Each heating plate assembly is provided with a hood 92 and an air supply system comprising a fan 94 which draws air from the atmosphere and blows it into an inlet duct 96. This duct 96 opens into the interior of frame 80 and through aperture in the frame inner wall and the insulation 82 this air is blown into the compartment containing the heating elements 86. The air passes through the sintered plate 84 through the foil and tile, and into the chamber 12.

Control console 34 has a panel 100 carrying the various instruments and dials for indicating the condition and operation of the machine.

FIG. 6 as stated previously shows part of the pneumatic, vacuum and electrical systems of the machine and it will be understood these systems will be interlinked to give the desired sequence of operations, and automatic safeguards and warnings. The sequence of operations, it will be appreciated, is largely a matter of convenience and is capable of being achieved readily by persons skilled in the field of sequencing systems.

Figure 7:
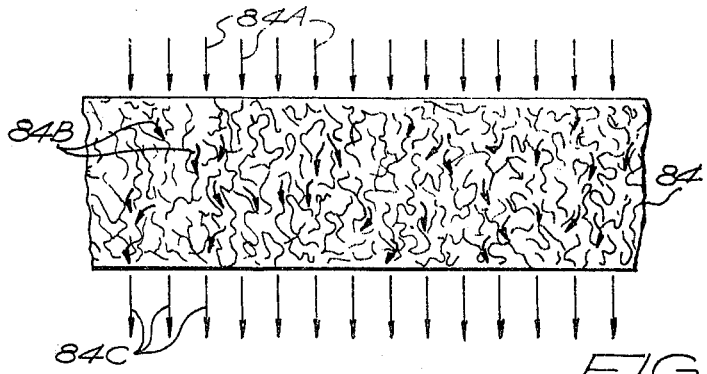
FIG. 7 is an enlarged sectional view of the press platen plate of sintered metal.

Referring now to FIGS. 7 to 10, these figures illustrate in detail how the advantageous effects of the invention are obtained. Considering firstly FIG. 7, this figure shows in section the sintered metal plate 84, which also forms the heating plate by which it is applied to the printing foil 51, to release the dyestuff. Also in FIG. 7 are shown arrows indicating the air flow through plate 84. When a pressure differential between the sides of plate 84 is applied, the air to the top of the plate is drawn towards and into the plate as indicated by arrows 84A. This air circulates evenly through the plate 84, as shown by individual arrows 84B. The air travels evenly through plate 84, and this is very important to the present invention. This effect can only be achieved by using a sintered plate, as such plates give even flow of air therethrough when pressure differential is applied. The air flow emerges from the bottom of the plate 84, as indicated by arrows 84C, in an even manner over the entire area of the bottom surface of plate 84. It is important that this picture of the air flow through plate 84 be maintained in order to have a full understanding of the advantageous effect of the present invention.

Turning now to FIGS. 7 to 10, these figs. show the segments, in cross-section, of the pile 50 being printed, the sintered plate 84, the printing foil 51 and the grid structure 84. In this example the pile 50 is shown as having the tuft pile 50A which is secured in conventional manner to a backing fabric 50B. In areas 51A, 51B and 51C of the face of foil 51 facing the tufts 50A, are indicated as being printed with sublimatic dyestuff. These areas 51A to 51C represent the pattern on the foil which has to be transferred to the tufts 50A of the pile. In FIG. 8, the heat applied through the sintered plate 84 is not yet sufficient to vapourise the dyestuff on areas 51A to 51C, but the vacuum has been applied to the underside of the pile through grid 48, and plate 84 has been pressed firmly into contact with the foil 51, pressing same to the tuft 50A. At this stage, there is a constant air flow through the sandwich of printing foil and pile, and the air flowing through this sandwich passes out through grid 48 as shown by arrows 48A in FIG. 8.

FIG. 9 indicates an intermediate stage in the dyeing process. The dyestuff has vapourised, but has not finally settled on the trufts 50A to dye. In other words, the dyestuff has sublimed, and is airborne. The regions of airborne dyestuff are indicated by 51B, 51E and 51F in FIG. 9. It will be seen that this dyestuff, being airborne, is being pulled down into the bricks of the tufts 50A, giving good penetration of the dyestuff into the fabric pile. FIG. 10 shows the position after completion of the dyeing operation. It will be seen that the tufts located under the dyed areas 51A to 51C are now printed with dyestuff, and this dyestuff has penetrated deeply into the tuft height. It is true that the depth of colour is stronger nearer to tuft ends, but the penetration achieved by the air flow through the sandwich is sufficient to make the printed pile a commercially viable article.

The machine described, because of the novelty of the invention, is a prototype machine, and it is appreciated that the form of the machine may be changed as experience is gained in carrying out the printing of tiles.

In a modification of the operation of the machine described, the heating plate structure may be adapted to have its interior supplied with air under pressure and the pressure in this air would be applied to the printing foil through the sintered plate to maintain the air flow through the sheet structure to assist dye penetration.

The building up of pressure in the heating plate structure hood may be in addition or as an alternative to the creation of a vacuum in the tanks 12.

The machine will be provided with adjusting arrangements whereby the temperature to which the plate structures 14 are heated may be adjusted, the length of time the heat is applied may be adjusted, the vacuum in tanks 12 may be adjusted, the length of time the vacuum is applied may be adjusted, and the pressure applied to the printing foil and tile may be adjusted.

In some cases, better results are obtained if the tile is pre-heated before the printing process and for such cases the machine may be provided with a tile pre-heating unit. Alternatively, the heating plate structures could be used for the pre-heating of the tiles.

The present invention provides several notable advancements in the field of transfer printing. Firstly, it provides a relatively simple machine having parts which do not move during the printing operation, but yet permit the application of pressure to the printing foil and the fabric. Secondly, it enables, for the first time, deep pile fabrics to be printed with a good dyestuff penetration throughout the height of the pile. There is no loss of pressure application to the printing foil, as the sintered plate not only permits the air flow, including the good dyestuff penetration, but it also serves to apply the heat and more importantly, to apply the pressure which is necessary for satisfactory sublimatic printing, as has been confirmed in the International Dyer of Textile Printer of Mar. 19, 1971.

I claim:

1. A transfer printing press comprising a press platen in the form of an air permeable, sintered metal plate, an air permeable support platen means located in face-to-face relationship with the press platen, pressure means adapted to press a sandwich comprising an air permeable sheet structure to be printed and a sublimatic printing foil between the sintered metal plate and the support platen means, heating means for heating the sublimatic printing foil through the sintered metal plate to release the dyestuff from the printing foil, and means for creating a flow of air through the sintered metal plate, the sandwich of foil and sheet structure, and the support platen means when the dyestuff has been released from the printing foil.

* * * * *